US011293700B2

(12) United States Patent
Tsai

(10) Patent No.: US 11,293,700 B2
(45) Date of Patent: Apr. 5, 2022

(54) MULTI-THERMAL CHARACTERISTIC HEAT SINK FIN

(71) Applicant: Cooler Master Co., Ltd., New Taipei (TW)

(72) Inventor: Chang-han Tsai, New Taipei (TW)

(73) Assignee: Cooler Master Co., Ltd., Taipei (TW)

( * ) Notice: Subject to any disclaimer, the term of this patent is extended or adjusted under 35 U.S.C. 154(b) by 0 days.

(21) Appl. No.: 17/013,600

(22) Filed: Sep. 6, 2020

(65) Prior Publication Data

US 2021/0372710 A1 Dec. 2, 2021

Related U.S. Application Data

(60) Provisional application No. 62/925,778, filed on Oct. 25, 2019.

(51) Int. Cl.
*F28D 15/02* (2006.01)
*F28D 21/00* (2006.01)

(52) U.S. Cl.
CPC .. *F28D 15/0275* (2013.01); *F28D 2021/0029* (2013.01); *F28F 2275/12* (2013.01)

(58) Field of Classification Search
CPC ..... F28D 15/02; F28D 15/0275; F28D 21/00; F28F 2275/12; F28F 3/00; H05K 7/20; H05K 7/20127; H05K 7/20136; H05K 7/20336; G06F 1/20
USPC ..... 165/104.21, 104.26, 80.3; 361/697, 702, 361/703
See application file for complete search history.

(56) References Cited

U.S. PATENT DOCUMENTS 6,435,266 B1 * 8/2002 Wu ..... F28F 1/24 29/890.032
6,550,529 B1 * 4/2003 Horng ..... H01L 23/3672 165/182
6,640,888 B1 * 11/2003 Horng ..... F28F 1/24 257/722
6,646,875 B1 * 11/2003 Horng ..... F28F 3/02 257/793

(Continued)

FOREIGN PATENT DOCUMENTS

CN 201197255 Y * 2/2009

OTHER PUBLICATIONS

Machine Translation CN 201197255Y (Year: 2011).*

*Primary Examiner* — Len Tran
*Assistant Examiner* — Gustavo A Hincapie Serna

(57) ABSTRACT

A multi-thermal characteristic heat sink fin, comprising a first heat spreading plate, a second heat spreading plate, and a primary heat spreading plate is provided. A plurality of multi-thermal characteristic heat sink fins is assembled together to form a heat sink, further having at least a heat pipe assembled therethrough, and a base plate, assembled to the at least a heat pipe and in contact with a heat source. The primary heat spreading plate is sandwiched and enclosed within the first and second heat spreading plates, hindering debris, contaminants, and moisture from entering the surface interfaces therebetween. The material of the heat pipes and primary heat spreading plate is different from that of the first and second heat spreading plates. No heat treatment process of two or more different materials is required for assembly of the multi-thermal characteristic heat sink fin and at least a heat pipe assembled thereto.

14 Claims, 6 Drawing Sheets

(56) References Cited

U.S. PATENT DOCUMENTS 6,729,385 B1 * 5/2004 Huang ..... H01L 23/3672 174/16.3
6,749,011 B2 * 6/2004 Horng ..... F28F 1/30 165/80.3
7,120,026 B2 * 10/2006 Chen ..... H01L 23/3672 361/704
7,267,167 B2 * 9/2007 Lee ..... F28D 15/0266 165/104.33
8,952,582 B2 * 2/2015 Le Besnerais ..... H02K 9/02 310/64
2004/0026073 A1 * 2/2004 Alex ..... F28F 3/02 165/182
2006/0144580 A1 * 7/2006 Wang ..... F28F 1/32 165/182
2007/0006997 A1 * 1/2007 Hsieh ..... H01L 23/427 257/E23.103
2007/0095510 A1 * 5/2007 Lin ..... F28D 15/0275 165/104.33
2008/0105408 A1 * 5/2008 Zhang ..... B23K 33/00 165/104.33
2008/0121372 A1 * 5/2008 Zhou ..... H01L 23/4006 165/80.3
2008/0314555 A1 * 12/2008 Wu ..... F28F 1/32 165/182
2009/0316362 A1 * 12/2009 Li ..... H01L 23/3672 361/710
2010/0252240 A1 * 10/2010 Li ..... H01L 23/427 165/104.26
2013/0000872 A1 * 1/2013 Lin ..... F28F 1/32 29/890.03
2013/0025830 A1 * 1/2013 Lin ..... F28F 1/32 165/104.26
2015/0144307 A1 * 5/2015 Lin ..... H05K 7/2039 165/104.21
2017/0261271 A1 * 9/2017 Fanberg ..... F28F 1/30

* cited by examiner

MULTI-THERMAL CHARACTERISTIC HEAT SINK FIN

RELATED APPLICATIONS

The application claims the benefit of priority to U.S. provisional application No. 62/925,778, filed on Oct. 25, 2019, of which is incorporated herein by reference in its entirety.

TECHNICAL FIELD

Example embodiments relate generally to the field of heat transfer and, more particularly, to multi-thermal characteristic heat sink fins.

BACKGROUND

During operation of electronic systems, the heat generated by processors must be dissipated quickly and efficiently to keep operating temperatures within manufacturer recommended ranges, under, at times, challenging operating conditions. As these electronic systems increase in functionality and applicability so does operating speed of the processors used therein; with an increase in operating speeds and an increase in the number of processors employed, power requirements of the electronic systems also increase, which in turn, increases cooling requirements.

Several techniques have been developed for extracting heat from processors in electronic systems. One such technique is an air-cooling system, wherein a heat exchanger is in thermal contact with a processor, transporting heat away from the processor, and then air flowing over the heat exchanger removes heat therefrom. One type of heat exchanger is a heat sink.

Heat sinks are devices that are attached directly to a heat source, such as a processor, to enhance heat dissipation therefrom. In general, heat sink fins, heat pipes, and fans, individually, or in any combination, may also form a part of the heat sink to facilitate air flow over the part of the heat sink in thermal contact with the processor to remove heat therefrom. For heat sinks formed at least, with heat sink fins and heat pipes, a material choice between aluminum or copper heat sinks is often required, depending upon application and specification requirements and operating environment. While copper heat sinks may be optimal for certain heat extracting solutions, copper is heavier and more expensive than aluminum. However, for aluminum heat sinks, heat spreading and thermal performance may be sacrificed.

Generally, when aluminum is utilized with copper in a heat sink, a complex system of thermal interface materials with mechanical attachments is required, whereby, the system increases thermal resistance. When thermal interface materials are not utilized, galvanic corrosion issues may be created. For metallurgically and permanently joining copper with aluminum, thermal resistance is decreased, but, expense increases.

SUMMARY

In an embodiment, a multi-thermal characteristic heat sink fin, configured for at least a heat pipe to be slidably engaged therewith, comprising a first heat spreading plate, a second heat spreading plate, and a primary heat spreading plate is provided. The first, second, and primary heat spreading plates have at least a first opening, a second opening, and a primary opening, respectively. The primary heat spreading plate further has a heat pipe fixing hub, extending from a perimeter of the primary opening.

The primary heat spreading plate is mounted between the first and second heat spreading plates and the heat pipe fixing hub extends through the first opening. The at least a heat pipe is slidably engaged to the multi-thermal characteristic heat sink fin via the first, second, and primary openings, respectively.

A material of the primary heat spreading plate has a first thermal characteristic, and a material of the first heat spreading plate and a material of the second heat spreading plate, respectively, have a second thermal characteristic different from that of the first thermal characteristic.

In some embodiments, the second heat spreading plate further comprises at least a rivet shaft, and the first heat spreading plate further comprises at least a rivet fixing hole corresponding to the at least a rivet shaft. The primary heat spreading plate is mounted between the first and second heat spreading plates via the heat pipe fixing hub extending through the first opening and the at least a rivet shaft retained in the at least a rivet fixing hole.

In some embodiments, in addition to the second heat spreading plate further comprising at least a rivet shaft, and the first heat spreading plate further comprising at least a rivet fixing hole, the primary heat spreading plate further comprises a first contact surface and at least two pairs of opposite fixing folds near furthest opposing ends thereof, the at least two pairs of opposite fixing folds extend outward and perpendicular from the first contact surface, and the first heat spreading plate further comprises at least two pairs of opposite first fixing fold passageways near furthest opposing ends thereof, corresponding to the at least two pairs of opposite fixing folds. The primary heat spreading plate is mounted between the first and second heat spreading plates via the heat pipe fixing hub extending through the first opening, the at least a rivet shaft retained in the at least a rivet fixing hole, and the at least two pairs of opposite fixing folds extending outward over the at least two pairs of opposite first fixing fold passageways, respectively.

In some embodiments, the first heat spreading plate further comprises an accommodating side having a recessed surface surrounded and defined by an elevated rim, and the second heat spreading plate further comprises an inner surface having a rim area on a perimeter therearound, corresponding to the elevated rim. The primary heat spreading plate is mounted and enclosed within the recessed surface and elevated rim, preventing debris and contaminants from entering therein.

In some embodiments, a thermal spreading resistance of the first thermal characteristic material is less than a thermal spreading resistance of the second thermal characteristic material. In some embodiments, a weight per square centimeter of the first thermal characteristic material is greater than a weight per square centimeter of the second thermal characteristic material. In some embodiments the first thermal characteristic material is made of copper or copper alloy. In some embodiments, the second thermal characteristic material is made of aluminum or copper alloy.

In some embodiments, a shape of the at least a primary opening, at least a first opening, and at least a second opening is cylindrical, respectively, and corresponds to a shape of the at least a heat pipe. In some embodiments, a shape of the multi-thermal characteristic heat sink fin is quadrangular shape. In some embodiments, a shape of the primary heat spreading plate is a stretched octagonal shape resembling a rectangle.

In some embodiments, an amount of the at least a primary opening, at least a first opening, and at least a second opening is five. In some embodiments, an amount of the at least a primary opening, at least a first opening, and at least a second opening is greater than five. In some embodiments, an amount of the at least a primary opening, at least a first opening, and at least a second opening is less than five.

In some embodiments, an amount of the multi-thermal characteristic heat sink fin is more than one. The heat pipe fixing hub of each of the multi-thermal characteristic heat sink fins is mounted on the at least a heat pipe, forming parallel air passages therebetween via a length of the at least two pairs of opposite fixing folds and a length of the heat pipe fixing hub, forming a heat sink.

BRIEF DESCRIPTION OF THE DRAWINGS

Unless specified otherwise, the accompanying drawings illustrate aspects of the innovative subject matter described herein. Referring to the drawings, wherein like reference numerals indicate similar parts throughout the several views, several examples of heatsink fins incorporating aspects of the presently disclosed principles are illustrated by way of example, and not by way of limitation.

DETAILED DESCRIPTION

The following describes various principles related to heatsink fins by way of reference to specific examples of heatsink fins, and heat exchanger systems, including arrangements and examples of heat pipes, and fans embodying innovative concepts. More particularly, but not exclusively, such innovative principles are described in relation to selected examples of heatsink fins, and heat exchanger systems and well-known functions or constructions are not described in detail for purposes of succinctness and clarity. Nonetheless, one or more of the disclosed principles can be incorporated in various other embodiments of heatsink fins, and heat exchanger systems to achieve any of a variety of desired outcomes, characteristics, and/or performance criteria.

Thus, heatsink fins, and heat exchanger systems having attributes that are different from those specific examples discussed herein can embody one or more of the innovative principles, and can be used in applications not described herein in detail. Accordingly, embodiments of heatsink fins, and heat exchanger systems not described herein in detail also fall within the scope of this disclosure, as will be appreciated by those of ordinary skill in the relevant art following a review of this disclosure.

Example embodiments as disclosed herein are directed to multi-thermal characteristic heat sink fins. In an embodiment, a multi-thermal characteristic heat sink fin comprises a first heat spreading/containment plate, a second heat spreading/containment plate, and a primary heat spreading plate. A plurality of multi-thermal characteristic heat sink fins is assembled together to form a heat sink, wherein the heat sink further has a plurality of heat pipes assembled through the plurality of multi-thermal characteristic heat sink fins, and a base plate, assembled to the plurality of heat pipes and in contact with a heat source. The primary heat spreading plate is sandwiched and enclosed within the first and second heat spreading/containment plates, hindering debris, contaminants, and moisture from entering the surface interfaces therebetween, which would increase galvanic corrosion issues. The material of the heat pipes and primary heat spreading plate is different from that of the first and second heat spreading/containment plates. However, no heat treatment process of two or more different materials is required for assembly of the plurality of multi-thermal characteristic heat sink fins and plurality of heat pipes thereto.

Figure 1:
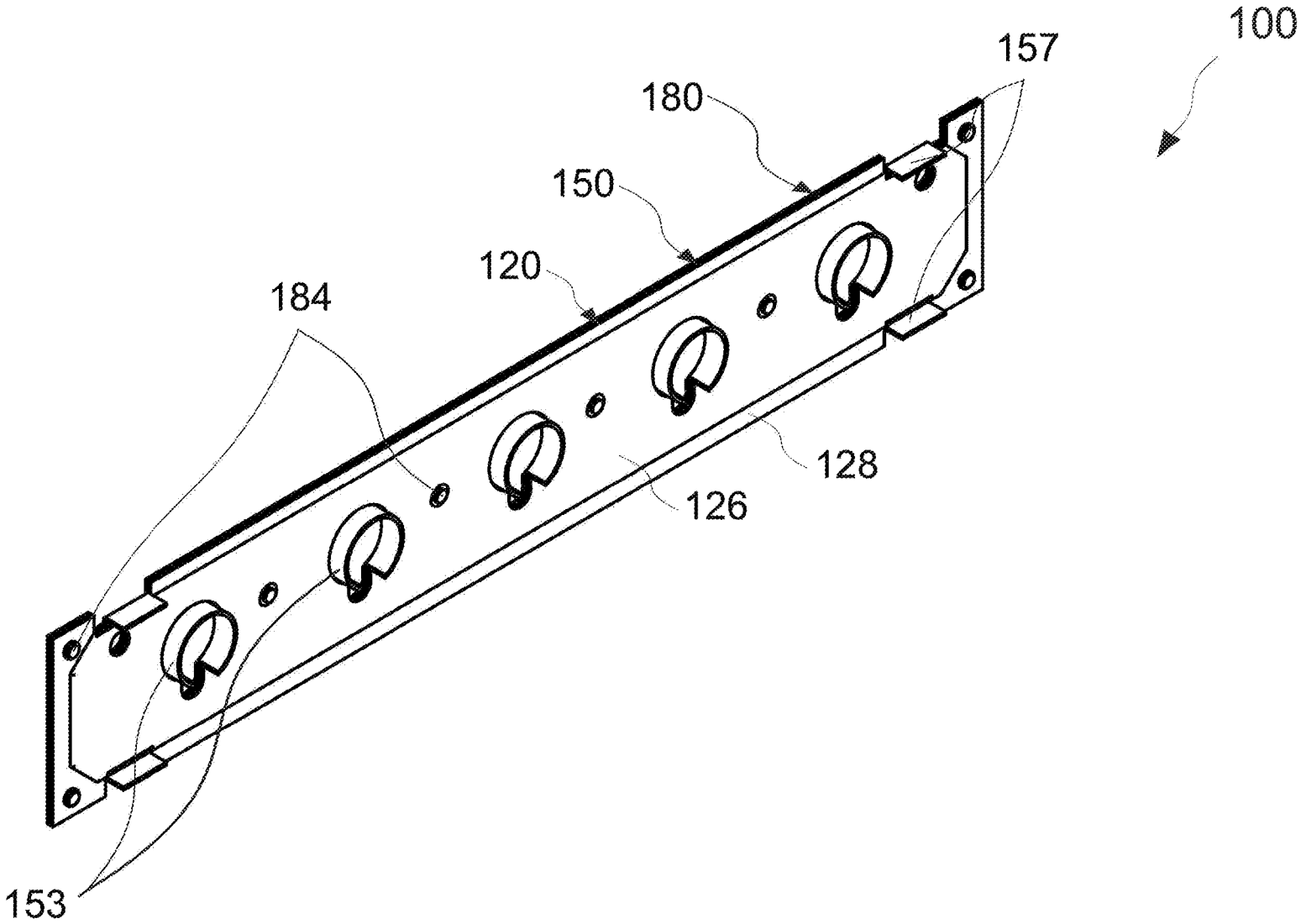
FIG. 1 is a schematic perspective view of a multi-thermal characteristic heat sink fin, according to an example embodiment.
Figure 2A:
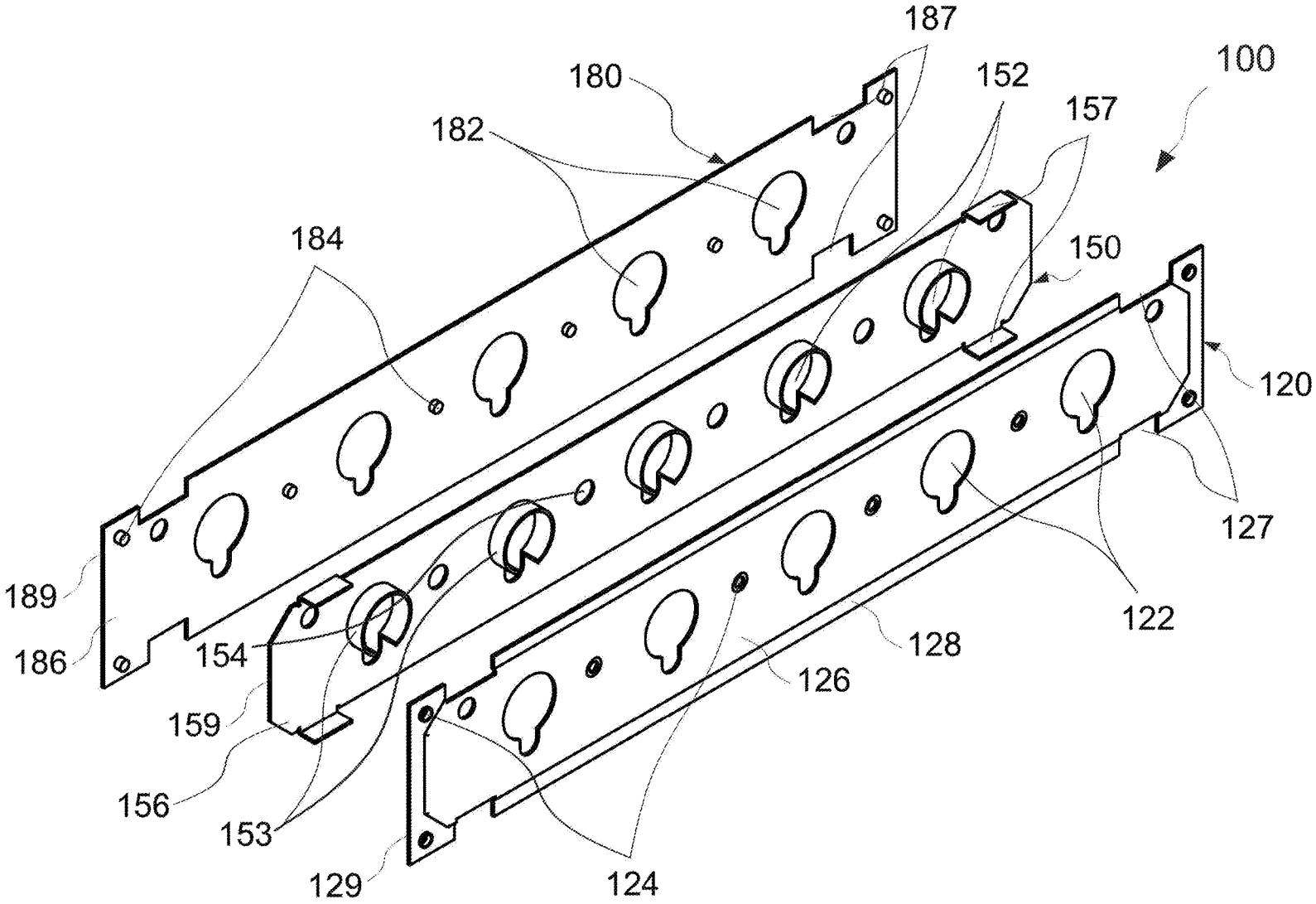
FIG. 2A is an exploded first view of the multi-thermal characteristic heat sink fin of FIG. 1, according to an example embodiment.
Figure 2B:
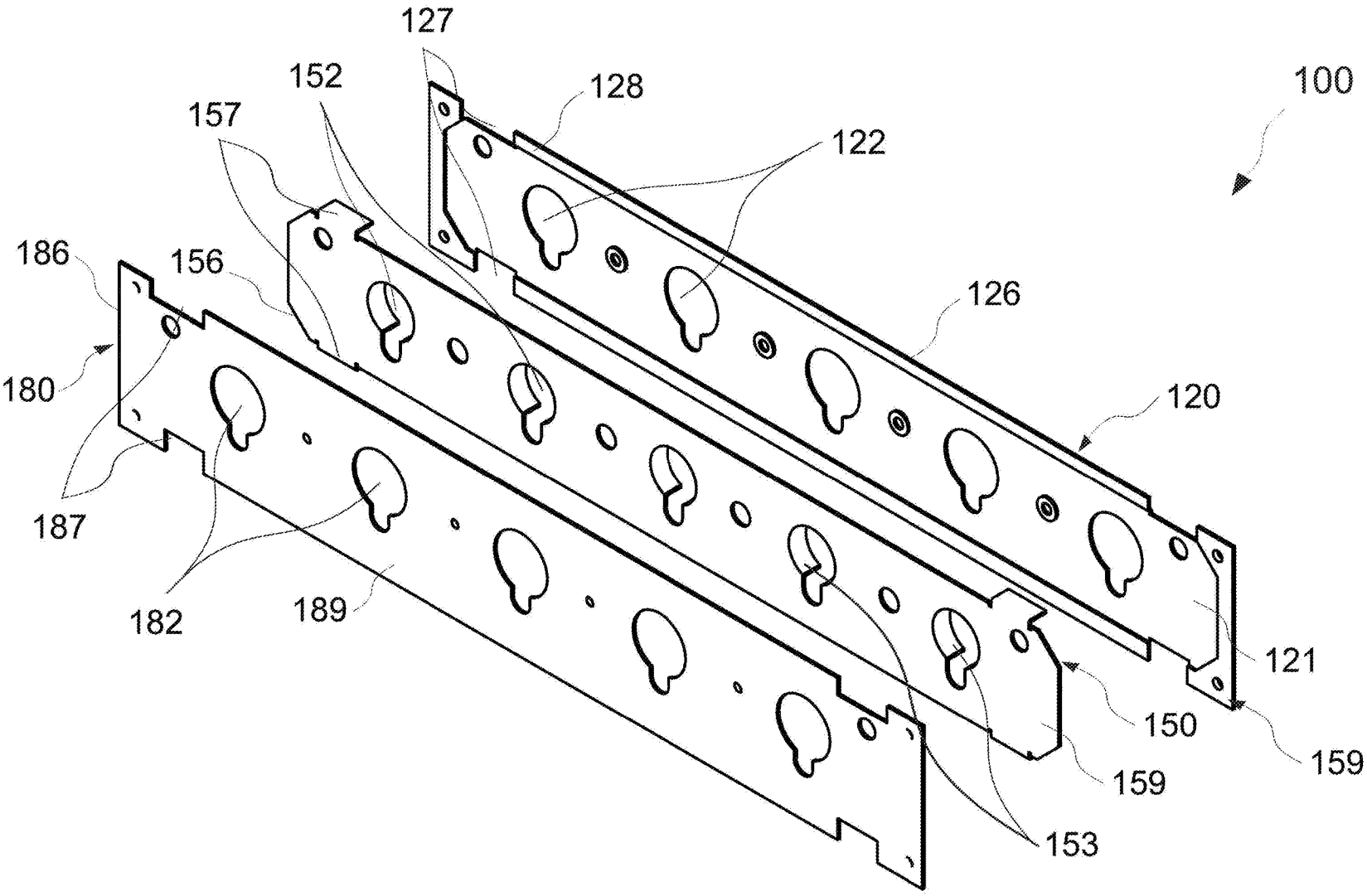
FIG. 2B is an exploded second view of the multi-thermal characteristic heat sink fin of FIG. 1, according to an example embodiment.

FIG. 1 is a schematic perspective view of a multi-thermal characteristic heat sink fin, according to an example embodiment. FIG. 2A is an exploded first view of the multi-thermal characteristic heat sink fin of FIG. 1, according to an example embodiment. FIG. 2B is an exploded second view of the multi-thermal characteristic heat sink fin of FIG. 1, according to an example embodiment. Referring to FIGS. 1 to 2B, a multi-thermal characteristic heat sink fin 100 is provided, comprising a first heat spreading/containment plate 120, a second heat spreading/containment plate 180 and a primary heat spreading plate 150. In an embodiment, the first heat spreading/containment plate 120 comprises an outer first side 126 and an accommodating side 129 having an elevated rim 128 on a perimeter therearound. In an embodiment, the first heat spreading/containment plate 120 further comprises a plurality of first heat pipe openings 122, a plurality of rivet fixing holes 124, and at least one pair of opposite first fixing fold passageways 127. In some embodiments, the at least one pair of opposite first fixing fold passageways 127 is disposed near furthest opposing ends of the first heat spreading/containment plate 120. The accommodating side 129 comprises a recessed surface 126 surrounded and defined by the elevated rim 128. In an embodiment, the second heat spreading/containment plate 180 comprises an outer second side 129, an inner surface 186, and rim area on a perimeter therearound, corresponding to the elevated rim 128 of the first heat spreading/containment plate 120. In an embodiment, the second heat spreading/containment plate 180 further comprises a plurality of second heat pipe openings 182, a plurality of rivet shafts 184, and at least one pair of opposite second fixing fold passageways 187. In some embodiments, the at least one pair of opposite second fixing fold passageways 187 is disposed near furthest opposing ends of the second heat spreading/containment plate 180. The surfaces of the outer second side 189 and inner surface 186 are generally flat-shaped. In an embodiment, the primary heat spreading plate 150 comprises a first contact surface 129 and a second contact surface 159. In an embodiment, the primary heat spreading plate 150 further comprises a plurality of primary heat pipe openings 152, each having a heat pipe fixing hub 153 extending from a perimeter thereof from the first contact surface 129, respectively, a plurality of rivet holes 154, and at least one pair of opposite fixing folds 157, extending outward, from the first contact surface 129 and perpendicular thereto. In some embodiments, the at least one pair of opposite fixing folds 157 is disposed near furthest opposing ends of the primary heat spreading plate 150. The surfaces of the first contact surface 129 and second contact surface 159 are generally flat-shaped.

In an embodiment, the first contact surface 129 of the primary heat spreading plate 150 is assembled to the recessed surface 126 and surrounding rim 128 of the accommodating side 129 of the first heat spreading/containment plate 120 via flushed fit therein. The thickness of the primary heat spreading plate 150 is generally equal to the depth of the recessed surface 126 and height of the elevated rim 128. The plurality of heat pipe fixing hubs 153 protrude through the plurality of first heat pipe openings 122, whereby the outer surface of the plurality of heat pipe fixing hubs 153 is flush with the perimeter of the plurality of first heat pipe openings 122, respectively. The at least one pair of opposite fixing folds 157, protrude through a plane of the at least one pair of opposite first fixing fold passageways 127, whereby an inner surface of the at least one pair of opposite fixing folds 157 is flush with a side edge of the at least one pair of opposite first fixing fold passageways 127. The flushed fit of the primary heat spreading plate 150 within the recessed surface 126 and surrounding rim 128, and flushed fit between the plurality of heat pipe fixing hubs 153 and plurality of first heat pipe openings 122 and at least one pair of opposite fixing folds 157 and at least one pair of opposite first fixing fold passageways 127, secures the primary heat spreading plate 150 to the first heat spreading/containment plate 120. Next, the inner surface 186 of the second heat spreading/containment plate 180 is assembled and fixed to the second contact surface 159 of the primary heat spreading plate 150 and rim 128 of the first heat spreading/containment plate 120 via the plurality of rivet shafts 184 of the second heat spreading/containment plate 180, retained in, corresponding plurality of rivet fixing holes 124 of the first heat spreading/containment plate 120 via interference fit.

In some embodiments, the thickness of the primary heat spreading plate 150, first heat spreading/containment plate 120, and second heat spreading/containment plate 180 may vary depending upon application and specification requirements, such as the size of the heat source and operating temperature generated therefrom, the dimensions and material of the base plate, the size and number of the plurality of heat pipes, and number of multi-thermal characteristic heat sink fins 100.

In some embodiments, the thickness of the at least one pair of opposite fixing folds 157, and plurality of heat pipe fixing hubs 153 may vary depending upon application and specification requirements as stated previously.

In some embodiments, the height of the at least one pair of opposite fixing folds 157, and plurality of heat pipe fixing hubs 153 may vary depending upon application and specification requirements as stated previously.

In some embodiments, the height of the plurality of rivet shafts 184 of the second heat spreading/containment plate 180 is slightly less than the thickness of the primary heat spreading plate 150 and elevated rim 128; however, the embodiments are not limited thereto. As long as the plurality of rivet shafts 184 may be securely retained in the corresponding plurality of rivet fixing holes 124 of the first heat spreading/containment plate 120.

In an embodiment, the material of the primary heat spreading plate 150 has a first thermal characteristic and the material of the first and second heat spreading/containment plates 120, 180 has a second thermal characteristic, different from that of the first thermal characteristic material. Portions of the second heat spreading/containment plate 180 in contact with the first heat spreading/containment plate 180 comprise at least one pair of opposite plurality of rivet shafts 184, retained in, corresponding at least one pair of opposite plurality of rivet fixing holes 124 of the first heat spreading/containment plate 120. Portions of the second heat spreading/containment plate 180 not in contact with the first heat spreading/containment plate 180 comprise centrally disposed plurality of rivet shafts 184, retained in, corresponding centrally disposed plurality of rivet fixing holes 124 of the first heat spreading/containment plate 120, through centrally disposed plurality of rivet holes 154 of the primary heat spreading plate 150. Fixed assembly of the multi-thermal characteristic heat sink fin 100 is achieved between the first and second heat spreading/containment plates 120, 180, made of the same thermal characteristic material.

The at least one pair of opposite fixing folds 157 and plurality of heat pipe fixing hubs 153 of the primary heat spreading plate 150, respectively, are exposed surface areas. However, the remaining surface areas of the primary heat spreading plate 150, such as the first and second contact surfaces 156, 159, are encompassed within the first and second heat spreading/containment plates 120, 180, hindering debris, contaminants, and moisture from entering the surface interfaces between the primary heat spreading plate 150 (first and second contact surfaces 156, 159 of the primary heat spreading plate 150) and first and second heat spreading/containment plates 120, 180 (accommodating side 129 of the first heat spreading/containment plate 120 and inner surface 186 of the second heat spreading/containment plate 180), hindering galvanic corrosion issues from occurring at the interface between the primary heat spreading plate 150 made of a material having a first thermal characteristic and the first and second heat spreading/containment plates 120, 180 made of a material having a second thermal characteristic.

In an embodiment, a plurality of multi-thermal characteristic heat sink fins 100 are assembled together, whereby the outer first side 126 of the first heat spreading/containment plate 120 is facing the outer second side 189 of the second heat spreading/containment plate 180 via contact with the at least one pair of opposite fixing folds 157. In some embodiments, a plurality of heat pipes are assembled to the plurality of multi-thermal characteristic heat sink fins via the plurality of heat pipe fixing hubs 153 of the primary heat spreading plates 150, respectively, forming a heat sink, whereby the plurality of heat pipes are also assembled to a base plate in thermal contact with a heat source, such as a processor.

In an embodiment, the plurality of multi-thermal characteristic heat sink fins 100 are assembled together in a linear array, such that an air path is defined between neighboring multi-thermal characteristic heat sink fins 10. Heat exchange is achieved, whereby heat from the heat source is transferred to the base plate, and then to the heat pipe, and then to the plurality of multi-thermal characteristic heat sink fins 100. When copper is utilized as the first thermal characteristic material, and is the same material as the heat pipes, and aluminum is utilized as the second thermal characteristic material, high thermal performance is achieved by the copper heat pipe to copper primary heat spreading plate 150 heat transfer, whilst minimizing weight, expense and galvanic corrosions issues via the non-heat treatment process assembly of the primary heat spreading plate 150 to the first and second heat spreading/containment plates 120, 180 and encasement of the primary heat spreading plate 150 between the first and second heat spreading/containment plates 120, 180. Generally, the multi-thermal characteristic heat sink fins 100 can be manufactured by low cost processes such as stamping, cutting and folding. Those of ordinary skill in the art will readily appreciate that materials other than copper and aluminum may be utilized to achieve the multi-thermal characteristic heat sink fin 100 of the embodiments, so long as the heat spreading ability of the first thermal characteristic material is greater than the second thermal characteristic material, the expense of the second thermal characteristic material is greater than the expense of the first thermal characteristic material, and the weight of the first thermal characteristic material is greater than the second thermal characteristic material.

In some embodiments, the heat pipes are hermetically sealed chambers having a wicking structure and a working fluid therein. The plurality of heat pipes is generally cylindrical in shape; however, the embodiments are not limited thereto. It should be appreciated that the cross-section of the plurality of heat pipes may be square, rectangular, elliptical or other cross-sectional shape, and hollow, and a closed-system, depending upon application and specification requirements. Also, the plurality of heat pipes may be of any suitable size, depending upon application and specification requirements. Those of ordinary skill in the relevant art may readily appreciate that the size of the plurality of heat pipes may depend on the size of the heat source and operating temperature generated therefrom, dimensions and material of the base plate, number of heat pipes utilized, and size and number of multi-thermal characteristic heat sink fins 100 utilized, and the embodiments are not limited. As long as the size and number of heat pipes correspond to the plurality of first and second heat pipe openings 122, 182 and plurality of primary heat pipe openings 152 of the plurality of multi-thermal characteristic heat sink fins 100. In some embodiments, the material of the plurality of heat pipes is copper; however, those of skill in the relevant art may readily appreciate that the plurality of heat pipes may be made of other heat-dissipating material. As long as the material of the plurality of heat pipes is the same as that of the primary heat spreading plate 150.

In some embodiments, the size, thickness, shape, and mounting means of the base plate are adapted to the size, thickness, shape, and mounting assembly of the heat source, such as a processor. The mounting means may be any mounting means known to those of ordinary skill in the relevant art. The material of the base plate may be a monolithic metal, for example, aluminum, or other heat-dissipating material known to those of ordinary skill in the relevant art. The plurality of heat pipes is mounted to the base plate via mounting means known to those of ordinary skill in the relevant art.

In some embodiments, the heat sink having the plurality of multi-thermal characteristic heat sink fins 100, further comprises an active fan, known to those of ordinary skill in the relevant art. The fan comprises multiple fan blades and provides airflow over the multi-thermal characteristic heat sink fins 100 and a portion of the plurality of heat pipes during operation. The fan is positioned on one side of the plurality of multi-thermal characteristic heat sink fins 100 and orthogonal thereto, further increasing the heat-dissipating capacity of the heat sink.

Figure 3:
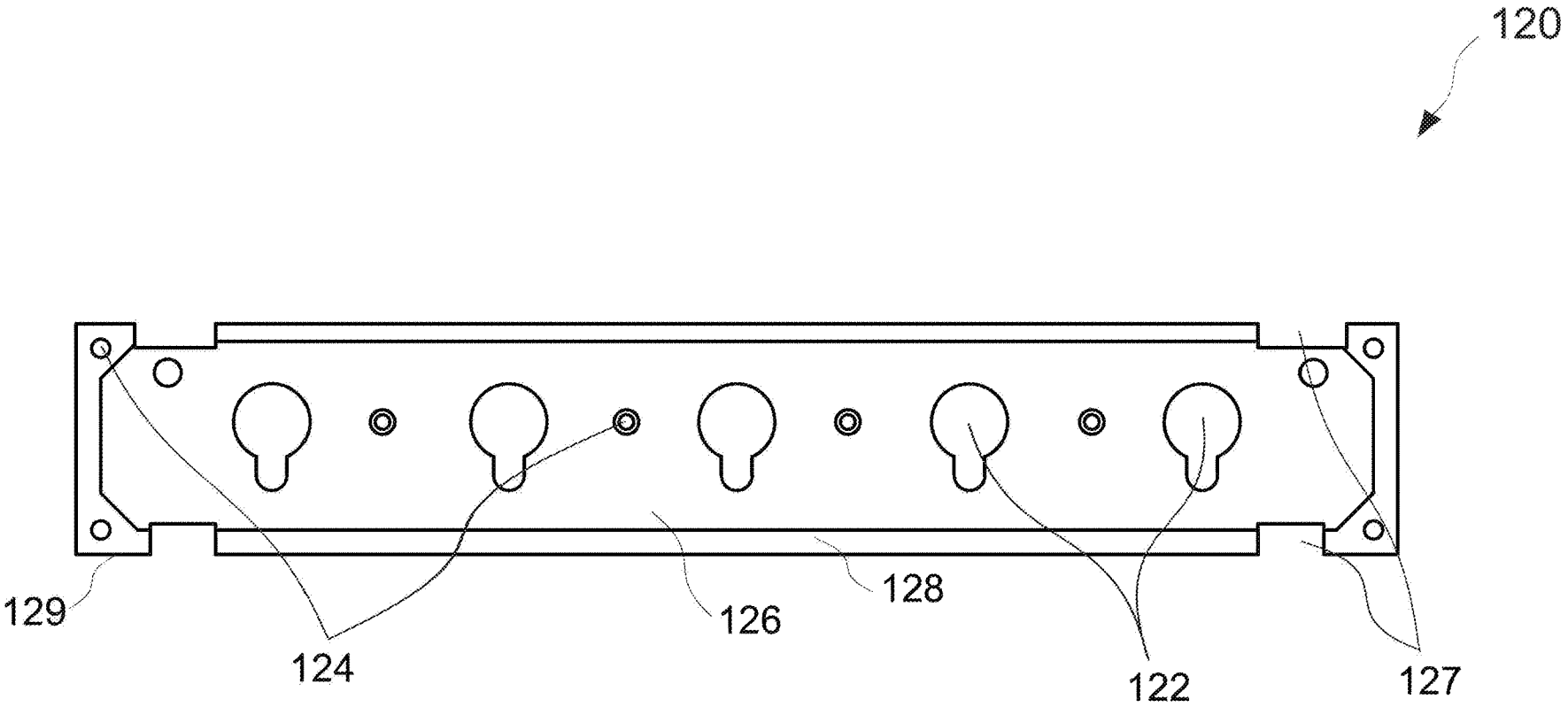
FIG. 3 is a schematic perspective view of a first heat spreading/containment plate of the multi-thermal characteristic heat sink fin of FIG. 1, according to an example embodiment.
Figure 4:
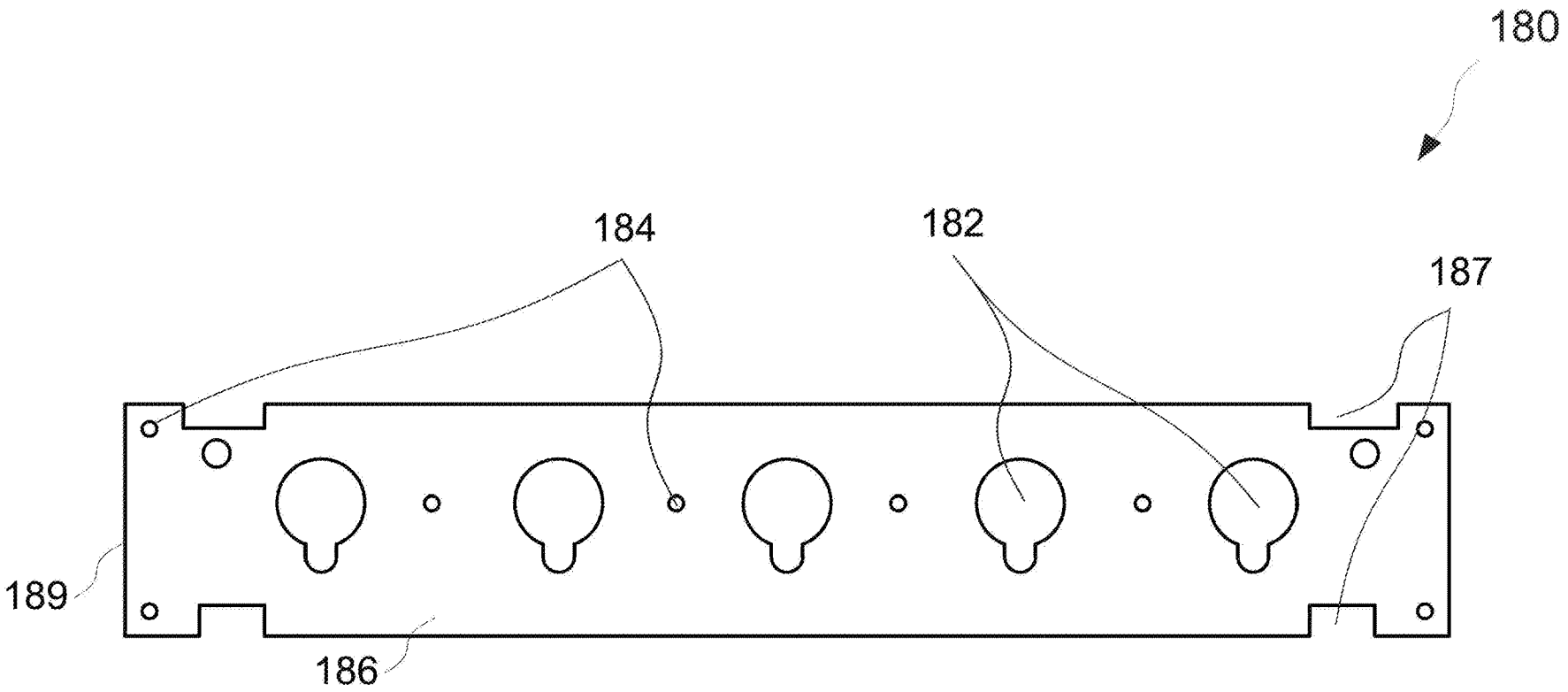
FIG. 4 is a schematic perspective view of a second heat spreading/containment plate of the multi-thermal characteristic heat sink fin of FIG. 1, according to an example embodiment.
Figure 5:
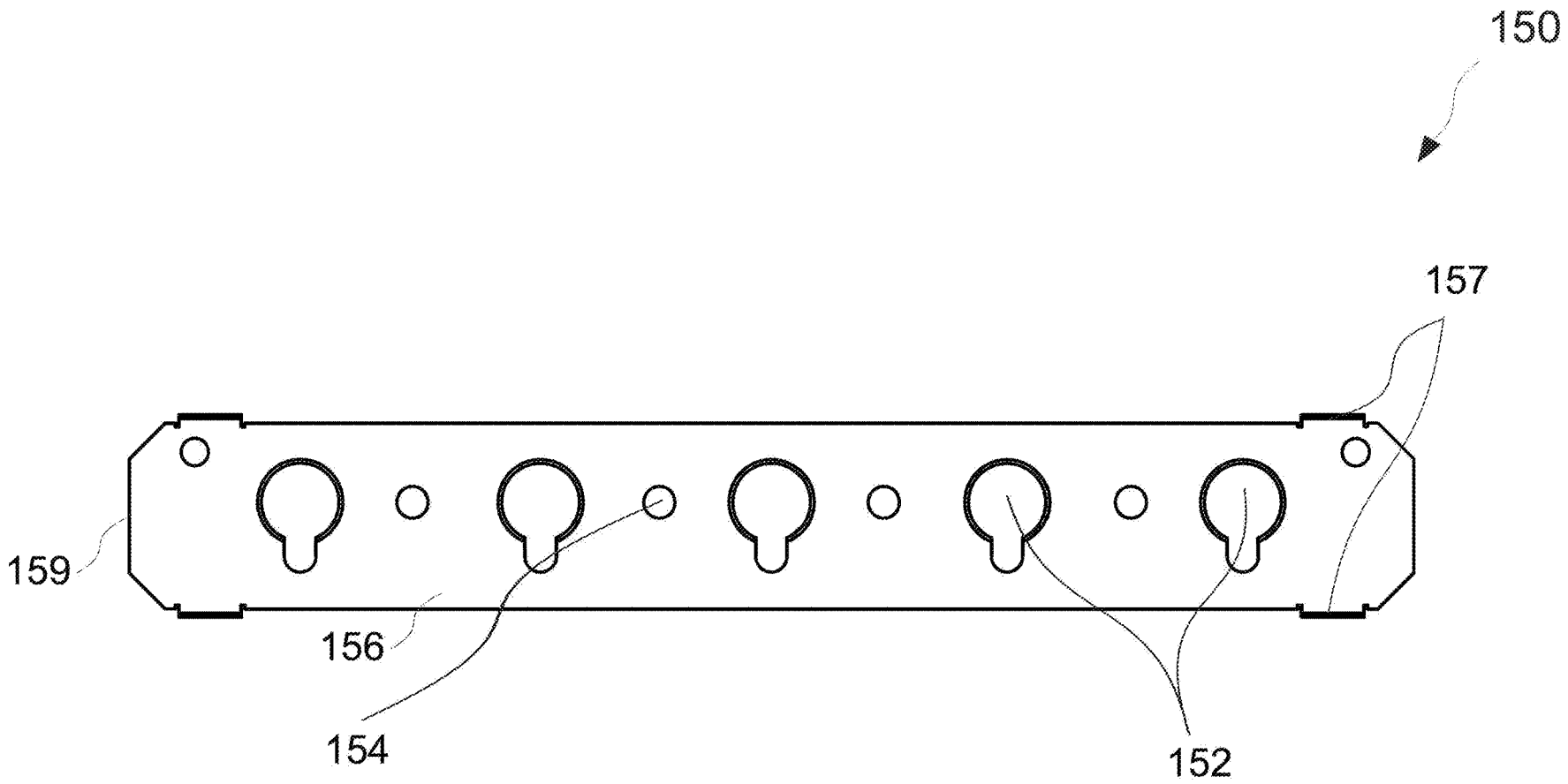
FIG. 5 is a schematic perspective view of a primary heat spreading plate of the multi-thermal characteristic heat sink fin of FIG. 1, according to an example embodiment.

FIG. 3 is a schematic perspective view of a first heat spreading/containment plate of the multi-thermal characteristic heat sink fin of FIG. 1, according to an example embodiment. FIG. 4 is a schematic perspective view of a second heat spreading/containment plate of the multi-thermal characteristic heat sink fin of FIG. 1, according to an example embodiment. FIG. 5 is a schematic perspective view of a primary heat spreading plate of the multi-thermal characteristic heat sink fin of FIG. 1, according to an example embodiment. Referring to FIGS. 3 to 5, and referring to FIGS. 1 to 2B, in an embodiment, the multi-thermal characteristic heat sink fin 100 achieves significant contact with ambient air, providing a substantial surface area which allows for efficient heat dissipation from a heat source when heat pipes are assembled thereto and to a base plate in contact with the heat source. Heat spreading benefits of, for example, copper heat pipes in contact with the copper primary heat spreading plate 150 is achieved, with additional lightweight and minimal additional expense heat dissipation via the first and second heat spreading/containment plate 120, 180. In some embodiments the shape of the first and second heat spreading/containment plates 120, 180 is rectangular, with height and length dimensions varied, depending upon application and specification requirements, such as the size of the plurality of heat pipes, and the embodiments are not limited.

In some embodiments the shape of the primary heat spreading plate 150 is generally a stretched octagonal shape resembling a rectangle, with height and length dimensions varied, depending upon application and specification requirements. As long as the first and second contact surfaces 156, 159, are encompassed within the first and second heat spreading/containment plates 120, 180, hindering debris, contaminants, and moisture from entering the surface interfaces between the primary heat spreading plate 150 and first and second heat spreading/containment plates 120, 180, and the plurality of heat pipe fixing hubs 153 protrude through the plurality of first heat pipe openings 122, whereby the outer surface of the plurality of heat pipe fixing hubs 153 is flush with the perimeter of the plurality of first heat pipe openings 122, respectively, and the at least one pair of opposite fixing folds 157, protrude through a plane of the at least one pair of opposite first fixing fold passageways 127, whereby an inner surface of the at least one pair of opposite fixing folds 157 is flush with a side edge of the at least one pair of opposite first fixing fold passageways 127.

Although illustrated as being quadrangular; however the embodiments are not limited thereto. It should be appreciated that the shape of the multi-thermal characteristic heat sink fin 100 may be round, oval, or some other geometric shape, depending upon application and specification requirements and the embodiments are not limited thereto.

In some embodiments, the number of multi-thermal characteristic heat sink fins 100 in an assembled heat sink may vary, depending upon operating temperature of the heat source, weight limitations, the type of active fan utilized, if employed, and cost. In some embodiments, the number of multi-thermal characteristic heat sink fins 100 is varied, depending upon application and specification requirements as stated previously.

In some embodiments, the general shape of the plurality of primary heat pipe openings 152 and plurality of first and second heat pipe openings 122, 182 corresponds to the shape of the heat pipes. As an example and not to be limiting, the general shape of the plurality of primary heat pipe openings 152 and plurality of first and second heat pipe openings 122, 182 is cylindrical; however, the embodiments are not limited thereto and depend on the shape of the heat pipes.

In some embodiments, the plurality of primary heat pipe openings 152 is substantially the same as outer dimensions of heat pipes assembled therethrough. The plurality of first and second heat pipe openings 122, 182 is substantially the same and larger than the plurality of primary heat pipe openings 152 by generally the thickness of the heat pipe fixing hub 153. As an example, and not to be limiting, the diameter of the outer dimensions of the plurality of heat pipes may vary, the diameter of the first and second heat pipe openings 122, 182 may vary, and given a thickness of the heat pipe fixing hub 153, the diameter of the plurality of primary heat pipe openings 152 may vary, all depending upon application and specification requirements.

In some embodiments, the number of the plurality of primary heat pipe openings 152 and plurality of first and second heat pipe openings 122, 182 is 5; however the embodiments are not limited thereto. Those of ordinary skill in the art may readily appreciate that there may be more than or less than 5 plurality of primary heat pipe openings 152 and plurality of first and second heat pipe openings 122, 182, depending on application and specification requirements as previously stated.

When engaged through the plurality of primary heat pipe openings 152, the heat pipes are in physical contact with the plurality of primary heat pipe openings 152 and plurality of heat pipe fixing hubs 153. To achieve close contact, the plurality of primary heat pipe openings 152 and plurality of first and second heat pipe openings 122 comprise an expandable tail for snug fitting. In some embodiments, the heat pipes are slidably engaged with the multi-thermal characteristic heat sink fins 100 during assembly of a heat sink.

In the embodiments, multi-thermal characteristic heat sink fins 100, comprising a first heat spreading/containment plate 120, a second heat spreading/containment plate 180, and a primary heat spreading plate 150 are provided. The primary heat spreading plate 150 is sandwiched and enclosed within the first and second heat spreading/containment plates 120, 180 via the recessed surface 126 of the accommodating side 129 of the first heat spreading/containment plate 120, at least one pair of opposite fixing folds 157 and plurality of heat pipe fixing hubs 153 of the primary heat spreading plate 150, and plurality of rivet shafts 184 of the second heat spreading/containment plate 180, retained in, corresponding plurality of rivet fixing holes 124 of the first heat spreading/containment plate 120 via interference fit. A plurality of multi-thermal characteristic heat sink fins are assembled together, whereby the outer first side 126 of the first heat spreading/containment plate 120 is facing the outer second side 189 of the second heat spreading/containment plate 180 via contact with the at least one pair of opposite fixing folds 157. A plurality of heat pipes are assembled to the plurality of multi-thermal characteristic heat sink fins via the plurality of heat pipe fixing hubs 153 of the primary heat spreading plates 150, respectively, forming a heat sink, whereby the plurality of heat pipes are also assembled to a base plate in thermal contact with a heat source, such as a processor.

The material of the primary heat spreading plate 150 has a first thermal characteristic and is the same as the material of the plurality of heat pipes. The material of the first and second heat spreading/containment plates 120, 180 has a second thermal characteristic, different from that of the first thermal characteristic material. No heat treatment process of two or more different thermal characteristic materials is required for assembly of the plurality of multi-thermal characteristic heat sink fins and plurality of heat pipes, thereby decreasing galvanic corrosion issues.

The at least one pair of opposite fixing folds 157 and plurality of heat pipe fixing hubs 153 of the primary heat spreading plate 150, respectively, are exposed surface areas. However, the remaining surface areas of the primary heat spreading plate 150, such as the first and second contact surfaces 156, 159, are encompassed within the first and second heat spreading/containment plates 120, 180, hindering debris, contaminants, and moisture from entering the surface interfaces between the primary heat spreading plate 150 (first and second contact surfaces 156, 159 of the primary heat spreading plate 150) and first and second heat spreading/containment plates 120, 180 (accommodating side 129 of the first heat spreading/containment plate 120 and inner surface 186 of the second heat spreading/containment plate 180), thereby also decreasing galvanic corrosion issues.

When copper is utilized as the first thermal characteristic material and aluminum is utilized as the second thermal characteristic material, the embodiments of the multi-thermal characteristic heat sink fin 100 provide high thermal performance with minimized weight, expense and galvanic corrosion issues. Thermal contact is achieved between the plurality of heat pipes, and the primary heat spreading plate 150, both made of copper. Thermal contact is also achieved between the primary heat spreading plate 150 made of copper and the first and second heat spreading/containment plates 120, 180 made of aluminum, whereby, no heat treatment process of copper in contact with aluminum is required. The plurality of multi-thermal characteristic heat sink fins is assembled together via the plurality of at least one pair of opposite fixing folds, in direct contact with each other, made of copper, the plurality of heat pipe fixing hubs 153 in direct contact with the plurality of heat pipes, all made of copper, and the base plate and a portion of the elevated rims of the multi-thermal characteristic heat sink fins, both made of aluminum, or combinations thereof.

The presently disclosed inventive concepts are not intended to be limited to the embodiments shown herein, but are to be accorded their full scope consistent with the principles underlying the disclosed concepts herein. Directions and references to an element, such as "up," "down,", "upper," "lower," "horizontal," "vertical," "left," "right," and the like, do not imply absolute relationships, positions, and/or orientations. Terms of an element, such as "first" and "second" are not literal, but, distinguishing terms. As used herein, terms "comprises" or "comprising" encompass the notions of "including" and "having" and specify the presence of elements, operations, and/or groups or combinations thereof and do not imply preclusion of the presence or addition of one or more other elements, operations and/or groups or combinations thereof. Sequence of operations do not imply absoluteness unless specifically so stated. Reference to an element in the singular, such as by use of the article "a" or "an", is not intended to mean "one and only one" unless specifically so stated, but rather "one or more". As used herein, "and/or" means "and" or "or", as well as "and" and "or." As used herein, ranges and subranges mean all ranges including whole and/or fractional values therein and language which defines or modifies ranges and subranges, such as "at least," "greater than," "less than," "no more than," and the like, mean subranges and/or an upper or lower limit. All structural and functional equivalents to the elements of the various embodiments described throughout the disclosure that are known or later come to be known to those of ordinary skill in the relevant art are intended to be encompassed by the features described and claimed herein. Moreover, nothing disclosed herein is intended to be dedicated to the public regardless of whether such disclosure may ultimately explicitly be recited in the claims. No element or concept disclosed herein or hereafter presented shall be construed under the provisions of 35 USC 112(f) unless the element or concept is expressly recited using the phrase "means for" or "step for".

In view of the many possible embodiments to which the disclosed principles can be applied, we reserve the right to claim any and all combinations of features and acts described herein, including the right to claim all that comes within the scope and spirit of the foregoing description, as well as the combinations recited, literally and equivalently, in the following claims and any claims presented anytime throughout prosecution of this application or any application claiming benefit of or priority from this application.

What is claimed is:

1. A multi-thermal characteristic heat sink fin, configured for at least a heat pipe to be slidably engaged therewith, comprising:

a first heat spreading plate having at least a first opening and an accommodating side having a recessed surface surrounded and defined by an elevated rim;

a second heat spreading plate having at least a second opening and an inner surface having a rim area on a perimeter therearound, corresponding to the elevated rim of the first heat spreading plate; and a primary heat spreading plate having at least a primary opening, wherein each primary opening comprises a heat pipe fixing hub extending from a perimeter thereof, wherein a material of the primary heat spreading plate has a first thermal characteristic, and a material of the first heat spreading plate and a material of the second heat spreading plate, respectively, has a second thermal characteristic different from that of the first thermal characteristic, and wherein the primary heat spreading plate is mounted between the first and second heat spreading plates and the heat pipe fixing hub extends through the first opening, whereby the at least a heat pipe is slidably engaged to the multi-thermal characteristic heat sink fin via the first, second, and primary openings, respectively, and whereby the primary heat spreading plate is mounted and enclosed within the recessed surface and elevated rim, preventing debris and contaminants from entering therein.

2. The multi-thermal characteristic heat sink fin of claim 1, wherein the second heat spreading plate further comprises at least a rivet shaft, and the first heat spreading plate further comprises at least a rivet fixing hole corresponding to the at least a rivet shaft, whereby the primary heat spreading plate is mounted between the first and second heat spreading plates via the heat pipe fixing hub extending through the first opening and the at least a rivet shaft retained in the at least a rivet fixing hole.

3. The multi-thermal characteristic heat sink fin of claim 1, wherein the primary heat spreading plate further comprises a first contact surface and at least two pairs of opposite fixing folds near furthest opposing ends thereof, the at least two pairs of opposite fixing folds extend outward and perpendicular from the first contact surface, and the first heat spreading plate further comprises at least two pairs of opposite first fixing fold passageways near furthest opposing ends thereof, corresponding to the at least two pairs of opposite fixing folds, whereby the primary heat spreading plate is mounted between the first and second heat spreading plates via the heat pipe fixing hub extending through the first opening, and the at least two pairs of opposite fixing folds extend outward over the at least two pairs of opposite first fixing fold passageways, respectively.

4. The multi-thermal characteristic heat sink fin of claim 1, wherein a thermal spreading resistance of the first thermal characteristic material is less than a thermal spreading resistance of the second thermal characteristic material.

5. The multi-thermal characteristic heat sink fin of claim 1, wherein a weight per square centimeter of the first thermal characteristic material is greater than a weight per square centimeter of the second thermal characteristic material.

6. The multi-thermal characteristic heat sink fin of claim 1, wherein the first thermal characteristic material is made of copper or copper alloy.

7. The multi-thermal characteristic heat sink fin of claim 1, wherein the second thermal characteristic material is made of aluminum or copper alloy.

8. The multi-thermal characteristic heat sink fin of claim 1, wherein a shape of the at least a primary opening, the at least a first opening, and the at least a second opening is cylindrical, respectively, and corresponds to a shape of the at least a heat pipe.

9. The multi-thermal characteristic heat sink fin of claim 1, wherein a shape of the multi-thermal characteristic heat sink fin is quadrangular shape.

10. The multi-thermal characteristic heat sink fin of claim 1, wherein a shape of the primary heat spreading plate is a stretched octagonal shape resembling a rectangle.

11. The multi-thermal characteristic heat sink fin of claim 1, wherein an amount of the at least a primary opening, the at least a first opening, and the at least a second opening is five.

12. The multi-thermal characteristic heat sink fin of claim 1, wherein an amount of the at least a primary opening, the at least a first opening, and the at least a second opening is greater than five.

13. The multi-thermal characteristic heat sink fin of claim 1, wherein an amount of the at least a primary opening, the at least a first opening, and the at least a second opening is less than five.

14. The multi-thermal characteristic heat sink fin of claim 1, wherein the primary heat spreading plate further comprises a first contact surface and at least two pairs of opposite fixing folds near furthest opposing ends thereof and an amount of the multi-thermal characteristic heat sink fin is more than one, whereby the heat pipe fixing hub of each of the multi-thermal characteristic heat sink fins is mounted on the at least a heat pipe, forming parallel air passages therebetween via a length of the at least two pairs of opposite fixing folds and a length of the heat pipe fixing hub, forming a heat sink.

* * * * *